US009429889B2

(12) United States Patent
Fujiwara et al.

(10) Patent No.: US 9,429,889 B2
(45) Date of Patent: Aug. 30, 2016

(54) IMAGE HEATING APPARATUS

(71) Applicant: CANON KABUSHIKI KAISHA, Tokyo (JP)

(72) Inventors: Yuji Fujiwara, Susono (JP); Yasuhiro Shimura, Yokohama (JP); Hideaki Yonekubo, Suntou-gun (JP); Hisashi Nakahara, Numazu (JP); Akira Kato, Mishima (JP); Noriaki Tanaka, Suntou-gun (JP); Hideyuki Matsubara, Mishima (JP); Hiroyuki Tanaka, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/539,262

(22) Filed: Nov. 12, 2014

(65) Prior Publication Data

US 2015/0139706 A1 May 21, 2015

(30) Foreign Application Priority Data

Nov. 18, 2013 (JP) ..... 2013-237911

(51) Int. Cl.
*G03G 15/20* (2006.01)

(52) U.S. Cl.
CPC ..... *G03G 15/2064* (2013.01); *G03G 15/2053* (2013.01); *G03G 15/2089* (2013.01); *G03G 2215/2016* (2013.01); *G03G 2215/2032* (2013.01); *G03G 2215/2035* (2013.01)

(58) Field of Classification Search
CPC ..... G03G 15/20
USPC ..... 399/329
See application file for complete search history.

(56) References Cited

U.S. PATENT DOCUMENTS 6,094,559 A * 7/2000 Otsuka ..... G03G 15/2025 399/327
6,384,378 B2 * 5/2002 Natsuhara ..... G03G 15/2053 219/216
6,392,197 B2 * 5/2002 Natsuhara ..... G03G 15/2064 219/216
7,193,181 B2 3/2007 Makihira et al.
7,203,438 B2 4/2007 Omata et al.

(Continued)

FOREIGN PATENT DOCUMENTS

JP 11-190951 A 7/1999
JP 2003-317898 * 11/2003 ..... G03G 15/20

(Continued)

OTHER PUBLICATIONS

U.S. Appl. No. 14/541,583, filed Nov. 14, 2014.

*Primary Examiner* — Clayton E LaBalle
*Assistant Examiner* — Kevin Butler
(74) *Attorney, Agent, or Firm* — Fitzpatrick, Cella, Harper & Scinto

(57) ABSTRACT

An image heating apparatus includes: a heater; a supporting member for supporting the heater; and a high heat-conductive sheet sandwiched between a part of the heater and the supporting member. A recording material on which an image is formed is heated by heat from the heater. The supporting member includes a bearing surface contacting the sheet so as to apply pressure between the heater and the sheet and includes an opposing portion opposing a part of the heater not sandwiching the sheet. In a state in which the pressure is applied between the heater and the sheet, the thickness of the sheet is not less than the height of the stepped portion between the bearing portion and the opposing portion.

11 Claims, 11 Drawing Sheets

(56) References Cited

U.S. PATENT DOCUMENTS

| | | | | |
|---|---|---|---|---|
| 7,283,145 | B2 | 10/2007 | Kato et al. | |
| 7,366,455 | B2 | 4/2008 | Iwasaki et al. | |
| 7,424,260 | B2 * | 9/2008 | Nishiyama | G03G 15/2042 399/329 |
| 7,518,089 | B2 * | 4/2009 | Hashiguchi | G03G 15/2057 219/216 |
| 7,630,662 | B2 | 12/2009 | Namiki et al. | |
| 7,650,105 | B2 | 1/2010 | Ogawa et al. | |
| 7,734,241 | B2 | 6/2010 | Nishida et al. | |
| 8,494,383 | B2 | 7/2013 | Shimura et al. | |
| 8,532,554 | B2 | 9/2013 | Uchiyama et al. | |
| 8,606,136 | B2 | 12/2013 | Shimura et al. | |
| 8,642,927 | B2 | 2/2014 | Shimura | |
| 8,653,422 | B2 * | 2/2014 | Shimura | H05B 3/0095 219/216 |
| 8,698,046 | B2 | 4/2014 | Shimura et al. | |
| 8,755,705 | B2 | 6/2014 | Nakahara et al. | |
| 8,818,214 | B2 | 8/2014 | Shimura | |
| 8,859,940 | B2 | 10/2014 | Shimura | |
| 8,884,192 | B2 | 11/2014 | Shimura | |
| 8,886,099 | B2 * | 11/2014 | Kanamori | F24J 3/00 399/329 |
| 2009/0230114 | A1 * | 9/2009 | Taniguchi | G03G 15/2042 219/216 |
| 2010/0310267 | A1 | 12/2010 | Shimura et al. | |
| 2012/0020709 | A1 | 1/2012 | Uchiyama et al. | |
| 2012/0308252 | A1 | 12/2012 | Shimura | |
| 2013/0266333 | A1 | 10/2013 | Fujiwara | |
| 2013/0266334 | A1 | 10/2013 | Shimura et al. | |
| 2014/0037301 | A1 | 2/2014 | Tanaka | |
| 2014/0169811 | A1 | 6/2014 | Shimura | |
| 2014/0169846 | A1 | 6/2014 | Shimura et al. | |
| 2014/0308051 | A1 | 10/2014 | Shimura | |
| 2015/0227091 | A1 * | 8/2015 | Ando | G03G 15/2046 399/33 |

FOREIGN PATENT DOCUMENTS

| | | | |
|---|---|---|---|
| JP | 2003-317898 | A | 11/2003 |
| JP | 2011-018027 | A | 1/2011 |

* cited by examiner

IMAGE HEATING APPARATUS

FIELD OF THE INVENTION AND RELATED ART

The present invention relates to an image heating apparatus suitable for use as a fixing device (apparatus) to be mounted in an image forming apparatus such as an electrophotographic copying machine or an electrophotographic printer, and relates to the image forming apparatus in which the image heating apparatus is mounted.

In the image forming apparatus in which the image heating apparatus is mounted, when continuous printing is performed using a small-sized recording material having a width smaller than a maximum-width recording material (sheet) usable in the image heating apparatus, a non-sheet-passing portion temperature rise is generated. This is a phenomenon in which the temperature in a region (non-sheet-passing portion) through which the small-sized sheet passes with respect to a longitudinal direction of a fixing nip rises.

As one of methods for suppressing this non-sheet-passing portion temperature rise, in Japanese Laid-Open Patent Application (JP-A) 2003-317898, a method in which a high heat-conductive sheet having high thermal conductivity is sandwiched between a heater supporting member and a ceramic heater has been proposed.

It has been turned out that in order to cause the high heat-conductive sheet to sufficiently exhibit the proper performance in suppressing the rise in the non-sheet-passing-portion temperature, there is a need to bring the sheet into contact with the heater at high pressure.

SUMMARY OF THE INVENTION

The present invention has been accomplished in view of the above-described problem, and a principal object of the present invention is to provide an image heating apparatus capable of applying pressure sufficiently to a high heat-conductive sheet.

Another object of the present invention is to provide the image heating apparatus having high positional accuracy of the high heat-conductive sheet relative to a heater.

According to an aspect of the present invention, there is provided an image heating apparatus comprising: a heater; a supporting member for supporting the heater; and a high heat-conductive sheet sandwiched between a part of the heater and the supporting member. A recording material on which an image is formed is heated by heat from the heater. The supporting member includes a bearing surface contacting the sheet so as to apply pressure between the heater and the sheet and includes an opposing portion opposing a part of the heater not sandwiching the sheet. In a state in which the pressure is applied between the heater and the sheet, the thickness of the sheet is not less than the height of a stepped portion between the bearing portion and the opposing portion.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiment 1

(1) Image Forming Apparatus

Figure 1:
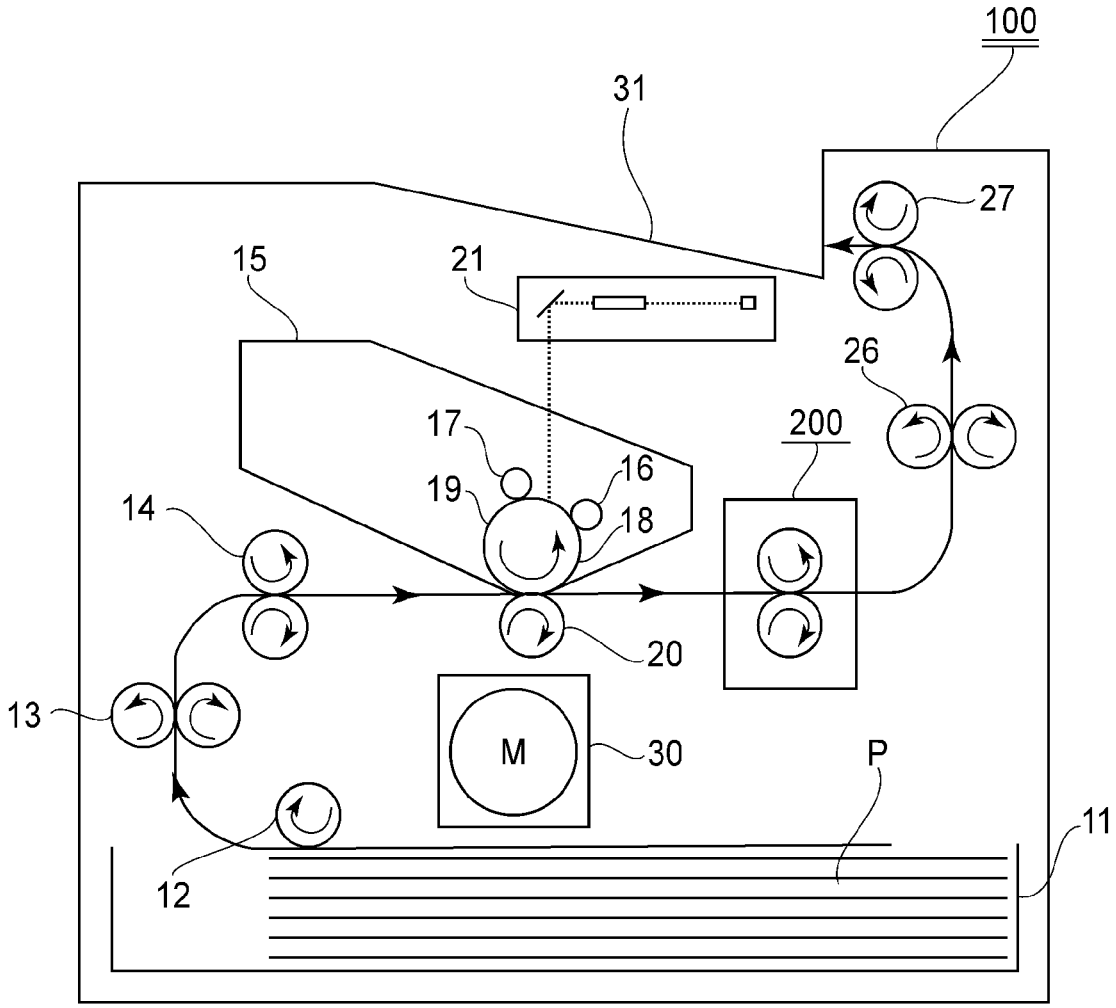
FIG. 1 is a schematic illustration of an image forming apparatus in Embodiment 1.

FIG. 1 is a schematic cross-sectional view of an example of an image forming apparatus 100 in which an image heating apparatus according to the present invention is mounted as a fixing device 200. This image forming apparatus 100 is a laser printer using electrophotographic recording technology, and forms an image, on a sheet (sheet-like recording material) P, corresponding to electrical image information inputted from a host device 500 (FIG. 6) such as a personal computer into a controller 101, and then prints out the sheet.

When a print signal is generated, a scanner unit 21 emits laser light modulated, depending on the image information, and scans a photosensitive member 19, which is electrically charged to a predetermined polarity by a charging roller 16 and which is rotationally driven in the counterclockwise direction indicated by an arrow in FIG. 1. As a result, an electrostatic latent image is formed on the photosensitive member 19. To this electrostatic latent image, a toner (developer) is supplied from a developing device 17, so that a toner image, depending on the image information, is formed on the photosensitive member 19. On the other hand, the sheets P stacked in a sheet-feeding cassette 11 are fed one by one by a pick-up roller 12, and then are fed toward a registration roller pair 14 by a roller pair 13.

Then, the sheet P is fed to a transfer position from the registration roller pair 14 in synchronism with timing when the toner image on the photosensitive member 19 reaches the transfer position formed between the photosensitive member 19 and a transfer roller 20. In a process in which the sheet P passes through the transfer position, the toner image is transferred from the photosensitive member 19 onto the sheet P. Therefore, the sheet P is heated by the fixing device 200, so that the toner image is heat-fixed on the sheet P. The sheet P carrying thereon the fixed toner image is discharged onto a tray 31 at an upper portion by roller pairs 26 and 27.

The image forming apparatus 100 includes a cleaner 18 for cleaning the photosensitive member 19 and a motor 30 for driving the fixing device 200 and the like. The photosensitive member 19, the charging roller 16, the scanner unit 21, the developing device 17, the transfer roller 20, and the like, which are described above, constitute an image forming portion. The photosensitive member 19, the charging roller 16, the developing device 17 and the cleaner 18 are constituted as a process cartridge 15 detachably mountable to a main assembly of the printer in a collective manner. An operation and image forming process of the above-described image forming portion are well known, and therefore will be omitted from detailed description.

The laser printer 100 in this embodiment uses a plurality of sheet sizes. Specifically, the laser printer 100 is capable of printing the image on sheets having the plurality of sheet sizes, including a letter paper size (about 216 mm×279 mm), an A4 paper size (210 mm×297 mm) and A5 paper size (148 mm×210 mm).

The printer basically feeds the sheet in a short-edge feeding manner (in which a long edge of the sheet is parallel to a (sheet) feeding direction) by center-line basis feeding, and a largest size (in width) of compatible regular sheet sizes (listed in a catalogue) is about 216 mm in width of the letter paper. This sheet having the largest width size is defined as a large-sized paper (sheet). Sheets (A4-sized paper, A5-sized paper and the like) having paper widths smaller than this sheet are defined as a small-sized paper.

The center-line basis feeding of the sheet P is such that even when any large and small (width) sheets capable of being passed through the printer are used, each of the sheets is passed through the printer in a manner in which a center line of the sheet with respect to a widthwise direction is aligned with a center (line) of a sheet feeding path with respect to the widthwise direction.

(2) Fixing Device (Image Heating Apparatus)

(2-1) Brief Description of Device Structure

Figure 2:
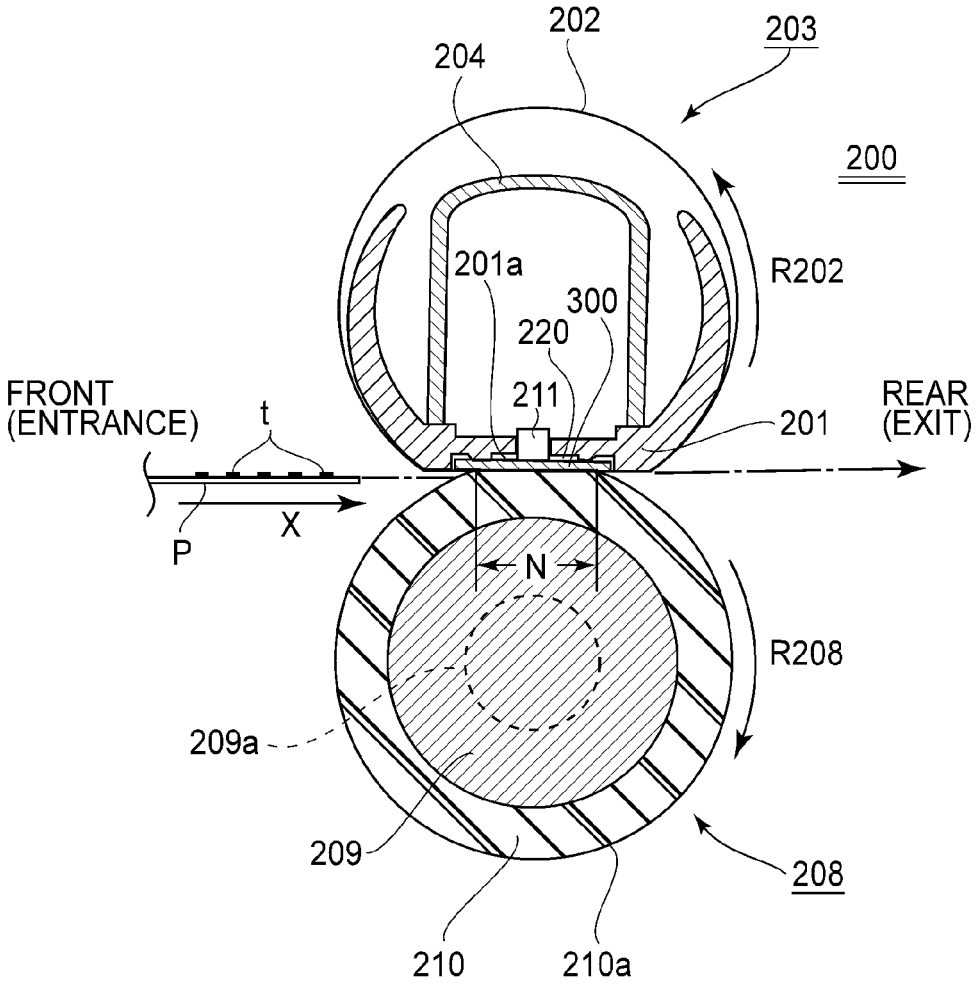
FIG. 2 is a schematic cross-sectional view of a principal part of a fixing device (image heating apparatus).
Figure 3:
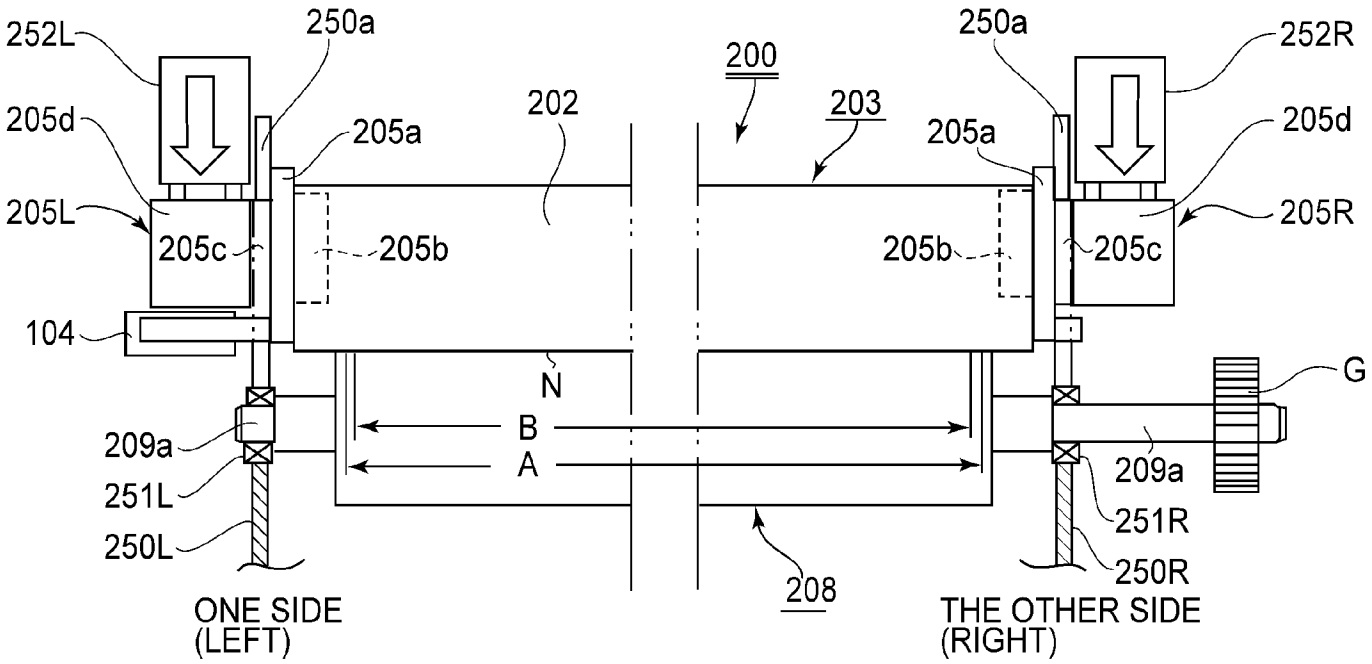
FIG. 3 is a schematic first view of the principal part of the fixing device which is partly omitted in midstream.
Figure 4:
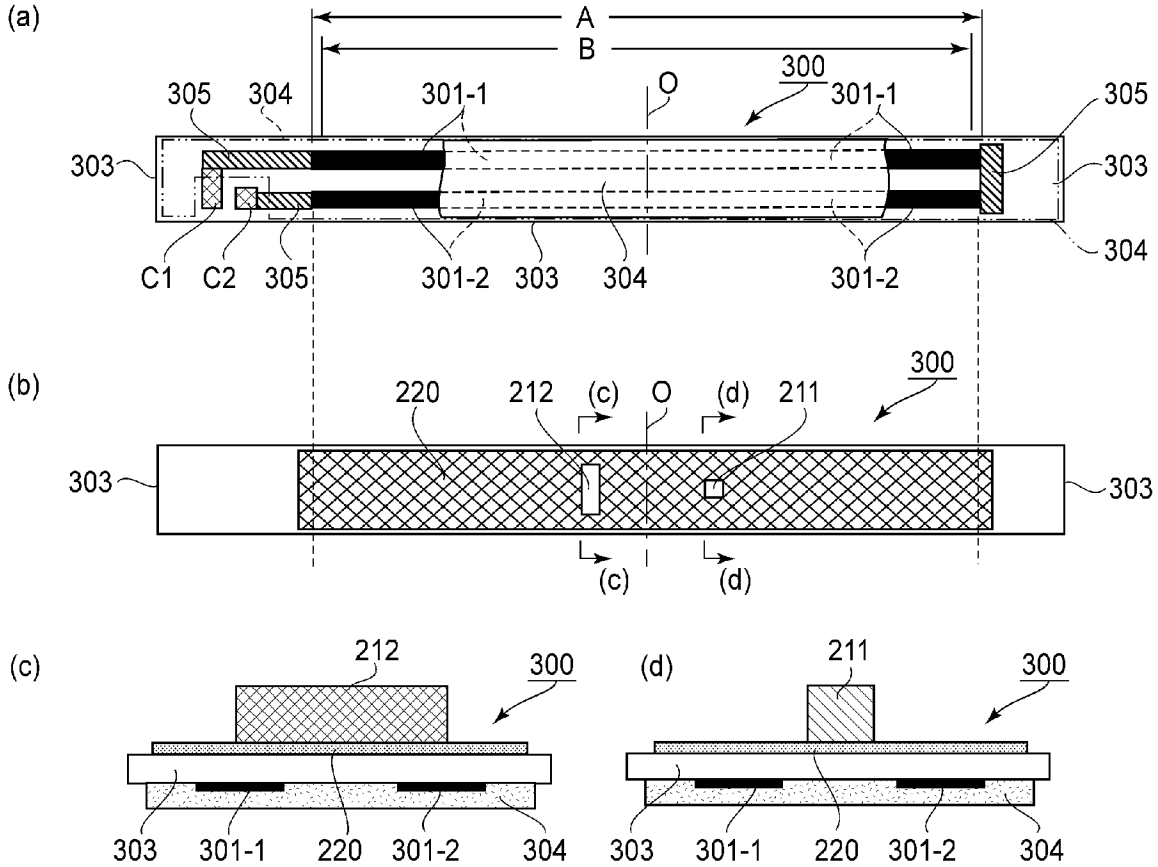
In FIG. 4, (a) to (d) are illustrations of a structure of a heater (heat generating element).
Figure 5:
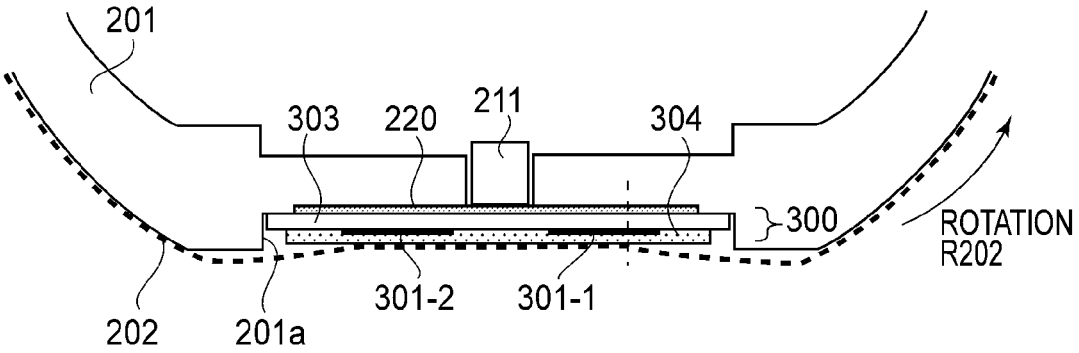
FIG. 5 is a partly enlarged view of FIG. 2.
Figure 6:
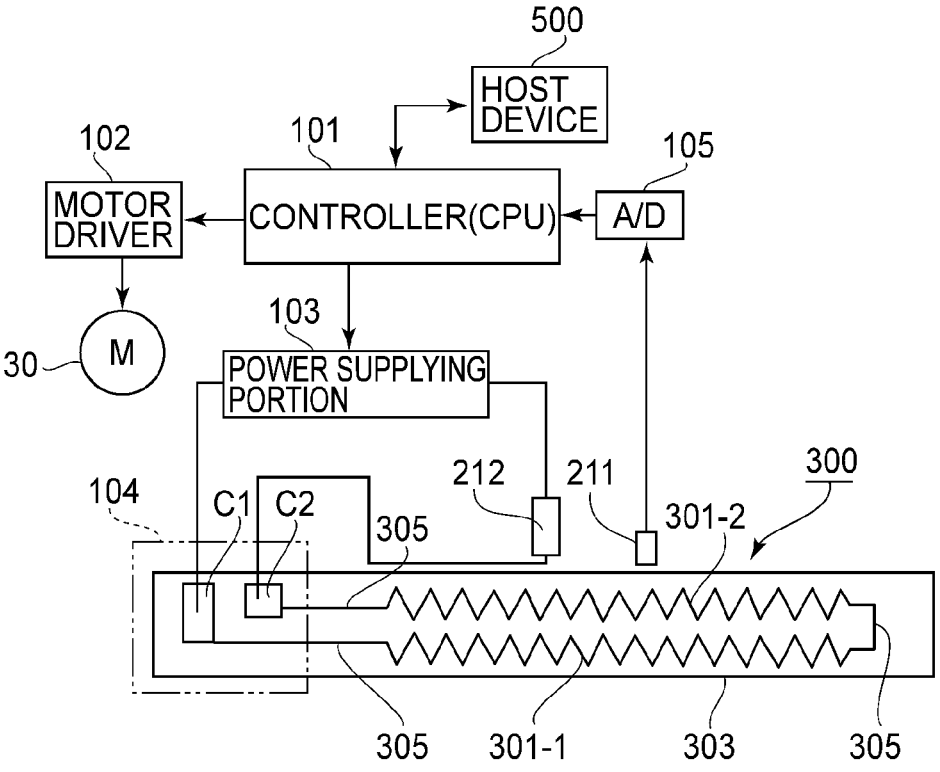
FIG. 6 is a block diagram of a control system.

FIG. 2 is a schematic cross-sectional view of a principal part of a fixing device 200 in this embodiment. FIG. 3 is a schematic first view of the principal part of the fixing device 200 which is partly omitted in midstream. In FIG. 4, (a) to (d) are illustrations of a structure of a heater (heat generating element). FIG. 5 is a partly enlarged view of FIG. 2. FIG. 6 is a block diagram of a control system.

With respect to the fixing device 200 and constituent elements thereof in this embodiment, a front side (surface) is a side (surface) when the fixing device 200 is seen from a sheet entrance side thereof, and a rear side (surface) is a side (surface) (sheet exit side) opposite from the front side. Left and right are left (one end side) and right (the other end side) when the fixing device 200 is seen from the front side. Further, an upstream (side) and a downstream (side) are those with respect to a sheet feeding direction X.

A longitudinal direction (widthwise direction) and a sheet width direction of the fixing device are directions substantially parallel to a direction perpendicular to the feeding direction X of the sheet P (or a movement direction (movable member movement direction) of a film which is a movable member). A short direction of the fixing device is a direction substantially parallel to the feeding direction X of the sheet P (or the movement direction of the film).

The fixing device 200 in this embodiment is an on-demand fixing device of a film (belt) heating type and a tension-less type. The fixing device 200 roughly includes a film unit 203 including a flexible cylindrical (endless) film (belt) 202 as the movable member, and includes a pressing roller (elastic roller: rotatable pressing member) 208, having a heat-resistant property and elasticity, as a nip-forming member.

The film unit 203 is an assembly of a heater 300 as a heating member, a high heat-conductive member 220, a heater supporting member 201, a pressing stay 204, regulating members (flanges) 205 (L, R) for regulating shift (lateral deviation) of the film 202, and the like.

The film 202 is a member for conducting method to the sheet P, and has a composite structure consisting of a cylindrical base layer (base material layer), an elastic layer formed on an outer peripheral surface of the base layer, a parting layer as a surface layer formed on an outer peripheral surface of the elastic layer, and an inner surface coating layer formed on an inner peripheral surface of the base layer. A material for the base layer is a heat-resistant resin such as polyimide or metal such as stainless steel.

Each of the heater 300, the high heat-conductive member 220, the heater supporting member 201 and the pressing stay 204 is a long member extending in a left-right direction of the fixing device. The film 202 is externally fitted loosely onto an assembly of the stay 204 and the heater supporting member 201 on which the heater 300 and the high heat-conductive member 220 are supported. The regulating members 205 (L, R) are mounted on one end portion and the other end portion of the pressing stay 204 in one end side and the other end side of the film 202, so that the film 202 is interposed between the left and right regulating members 205L and 205R.

The heater 300 is a ceramic heater in this embodiment. The heater 300 has a basic structure including a ceramic substrate having an elongated thin plate shape and a heat generating element (heat generating resistor) which is provided on a surface of this substrate in one side of the substrate and which generates heat by energization (supply of electric power) to the heat generating element, and is a low-thermal-capacity heater increased in temperature with an abrupt rising characteristic by the energization to the heat generating element. A specific structure of the heater 300 will be described in (3) below in detail.

The heater supporting member 201 is a molded member formed of the heat-resistant resin, and is provided with a heater-fitting groove 201*a* along a longitudinal direction of the member at a substantially central portion with respect to a circumferential direction of the outer surface of the member. The high heat-conductive member 220 and the heater 300 are fitted (engaged) into and supported by the heater-fitting groove 201*a*. In the groove 201*a*, the high heat-conductive member 220 is interposed between the heater supporting member 201 and the heater 300. The high heat-conductive member 220 will be described in (3) specifically.

The heater supporting member 201 not only supports the high heat-conductive member 220 and the heater 300 but also functions as a guiding member for guiding rotation of the film 202 externally fitted onto the heater supporting member 201 and the pressing stay 204.

The pressing stay 204 is a member having rigidity, and is a member for providing a longitudinal strength to the heater supporting member 201 by being pressed against an inside (back side) of the resin-made heater supporting member 201 and for rectifying the heater supporting member 201. In this embodiment, the pressing stay 204 is a metal-molded material having an U-shape in cross section.

Each of the regulating members 205 (L, R) is a molded member formed of the heat-resistant resin so that the regulating members 205 (L, R) have a bilaterally symmetrical shape, and have the functions of regulating (limiting) movement (thrust movement) along the longitudinal direction of the heater supporting member 201 during the rotation of the film 202 and of guiding an inner peripheral surface of a film end portion during the rotation of the film 202. That is, each of the regulating members 205 (L, R) includes a flange portion 205*a*, for receiving (stopping) the film end surface, as a first regulating (limiting) portion for regulating the thrust movement of the film 202. Further, each of the regulating members 205 (L, R) includes an inner surface guiding portion 205*b* as a second regulating portion for guiding an inner surface of the film end portion by being fitted into the film end portion.

The pressing roller 208 is an elastic roller having a composite layer structure including a metal core 209 formed of a material such as iron or aluminum, an elastic layer 210 formed, of a material such as a silicone rubber, around the metal core in a roller shape, and a parting layer (surface layer) 210*a* coating an outer peripheral surface of the elastic layer 210.

The pressing roller 208 is provided so that each of rotation center shaft portions 209*a* in left and right end portion sides is rotatably supported in the associated one of left and right side plates 250 (L, R) of a fixing device frame via the associated one of bearing members (bearings) 251 (L, R). The right-side shaft portion 209*a* is provided concentrically integral with a drive gear G. To this drive gear G, a driving force of the motor 30 controlled by a controller 101 via a motor driver 102 is transmitted via a power transmitting mechanism (not shown). As a result, the pressing roller 208 is rotationally driven as a rotatable driving member at a predetermined peripheral speed in the clockwise direction of an arrow R208 in FIG. 2.

On the other hand, the film unit 203 is disposed on and substantially parallel with the pressing roller 208 while keeping a heater-disposed portion side of the heater supporting member 201 downward, and is disposed between the left and right side plates 250 (L, R). Specifically, a vertical guiding groove 205*c* provided in each of the left and right regulating members 250 (L, R) of the film unit 203 engages with an associated vertical guiding slit 250*a* provided in each of the left and right side plates 250 (L, R).

As a result, the left and right regulating members 205 (L, R) are supported by the left and right side plates 250 (L, R), respectively, so as to be vertically slidable (movable) relative to the left and right side plates 250 (L, R), respectively. That is, the film unit 203 is supported by and vertically slidable relative to the left and right side plates 250 (L, R). The heater-disposed portion of the heater supporting member 201 of the film unit 203 opposes the pressing roller 208 via the film 202.

Further, pressure-receiving portions 205*d* of the left and right regulating members 205 (L, R) are pressed at a predetermined pressing force (pressure) by left and right pressing mechanisms 252 (L, R), respectively. Each of the left and right pressing mechanisms 252 (L, R) is a mechanism including, e.g., a pressing spring, a pressing lever or a pressing cam. That is, the film unit 203 is pressed against the pressing roller 208 at the predetermined pressing force, so that the film 202 on the heater-disposed portion of the heater supporting member 201 is press-contacted to the pressing roller 208 against the elasticity of the elastic (material) layer 210 of the pressing roller 208.

As a result, the heater 300 contacts the inner surface of the film 202, so that a nip N having a predetermined width with respect to a film movement direction (movable member movement direction) is formed between the film 202 and the pressing roller 208. That is, the pressing roller 208 forms the nip N via the film 202 in combination with the heater 300.

The heater 300 exists on the heater supporting member 201 at a position corresponding to the nip N and extends in the longitudinal direction of the heater supporting member 201. In the fixing device 200 in this embodiment, the heater 300 and the heater supporting member 201 constitute a back-up member contacting the inner surface of the film 202. Further, the pressing roller 208 forms the nip N via the film 202 in combination with the back-up member (300, 201). In this way, the heater 300 is provided inside the film 202, and is press-contacted to the film 202 toward the pressing roller 208 to form the nip N.

(2-2) Fixing Operation

The fixing operation of the fixing device 200 is as follows. The controller 101 actuates the motor 30 at a predetermined control timing. From this motor 30 to the pressing roller 208, a rotational driving force is transmitted. As a result, the pressing roller 208 is rotationally driven at a predetermined speed in the clockwise direction of the arrow R208.

The pressing roller 208 is rotationally driven, so that at the nip N, a rotational torque acts on the film 202 by a frictional force with the film 202. As a result, the film 202 is rotated, by the rotation of the pressing roller 208, in the counter-clockwise direction of an arrow R202 around the heater supporting member 201 and the pressing stay 204 at a speed substantially corresponding to the speed of the pressing roller 208 while being slid in close contact with the surface of the heater 300 at the inner surface thereof. Onto the inner surface of the film 202, a semisolid lubrication is applied, thus ensuring a sliding property between the outer surface of each of the heater 300 and the heater supporting member 201 and the inner surface of the film 202 in the nip N.

Further, the controller starts energization (supply of electric power) from a power supplying portion (power controller) 103 to the heater 300. The power supply from the power supplying portion 103 to the heater 300 is made is made via an electric connector 104 mounted in a left end portion side of the film unit 203. By this energization, the heater 300 is quickly increased in temperature.

The temperature increase (rise) is detected by a thermistor (temperature detecting element) 211 provided in contact with the high heat-conductive member 220 contacting the back surface (upper surface) of the heater 300. The thermistor 211 is connected with the controller 101 via an A/D converter 105. The film 202 is heated at the nip N by heat generation of the heater 300 by the energization.

The controller 101 samples an output from the thermistor 211 at a predetermined period, and the thus-obtained temperature information is reflected in temperature control. That is, the controller 101 determines the contents of the temperature control of the heater 300 on the basis of the output of the thermistor 211, and controls the energization to the heater 300 by the power supplying portion 103 so that a temperature of the heater 300 at a portion corresponding to the sheet-passing portion is a target temperature (predetermined set temperature).

In a control state of the fixing device 200 described above, the sheet P on which an unfixed toner image t is carried is fed from the image forming portion toward the fixing device 200, and then is introduced into the nip N. The sheet P is supplied with heat from the heater 300 via the film 202 in a process in which the sheet P is nipped and fed through the nip N. The toner image t is melt-fixed as a fixed image on the surface of the sheet P by the heat of the heater 300 and the pressure at the nip N. That is, the toner image on the sheet (recording material) is heated and fixed. The sheet P coming out of the nip N is curvature-separated from the film 202 and is discharged from the device 200, and then is fed.

The controller 101 stops, when the printing operation is ended, the energization from the power supplying portion 103 to the heater 300 by an instruction to end the fixing operation. Further, the controller stops the motor 30.

In FIG. 3, A is a maximum heat generation region width of the heater 300. B is a sheet-passing width (maximum sheet-passing width) of the large-sized paper, and is a width equal to or somewhat smaller than the maximum heat generation region width A. In this embodiment, the maximum sheet-passing width B is about 216 mm (short edge feeding) of the letter paper. A full length of the nip N formed by the film 202 and the pressing roller 208 (i.e., a length of the pressing roller 208) is a width larger than the maximum heat generation region width A of the heater 300.

(3) Heater 300

In FIG. 4, (a) is a schematic plan view of the heater 300 which is partly cut away in one surface side (front surface side), (b) is a schematic plan view of the heater 300 in the other surface side (back surface side), (c) is a sectional view at (c)-(c) position in (b) of FIG. 4, and (d) is a sectional view at (d)-(d) position in (b) of FIG. 4.

In this embodiment, the heater 300 is the ceramic heater. Basically, the heater 300 includes a heater substrate 303 formed by ceramic in an elongated thin plate shape, heat generating resistors (heat generating members 301-1 and 301-2 provided along the longitudinal direction of the substrate in one surface side (front surface side) of the heater substrate 303, and an insulating (surface) protecting layer 304 which covers the heat generating resistors.

The heater surface 303 is a ceramic substrate, formed of, e.g., $Al_2O_3$ or AlN in an elongated thin plate shape, extending in a longitudinal direction crossing with (perpendicular to) a sheet-passing direction at the nip N. Each of the heat generating resistors 301-1 and 301-2 is formed by pattern-coating an electric resistance material paste of, e.g., Ag/Pd (silver/palladium) by screen printing and then by baking the paste. In this embodiment, the heat generating resistors 301-1 and 301-2 are formed in strip shape, and the two heat generating resistors are formed to be parallel to each other along the longitudinal direction of the substrate with a predetermined interval therebetween on the substrate surface with respect to the short direction of the substrate.

In one end side (left side) of the heat generating resistors 301-1 and 301-2, the heat generating resistors are electrically connected to electrode portions (contact portions) C1 and C2, respectively, via electroconductive members 305. Further, in the other end side (right side) of the heat generating resistors 301-1 and 301-2, the heat generating resistors are electrically connected in series by an electroconductive member 305. Each of the electroconductive members 305 and the electrode portions C1 and C2 is formed by pattern-coating the electroconductive material paste such as Ag by the screen printing or the like and then by baking the paste.

The surface protecting layer 304 is provided so as to cover a whole of the heater substrate surface except for the electrode portions C1 and C2. In this embodiment, the surface protecting layer 304 is formed of glass by pattern-coating a glass paste by the screen printing or the like and then by baking the paste. The surface protecting layer 304 is used for protecting the heat generating resistors 301-1 and 301-2 and for maintaining electrical insulation.

The electric power is supplied to between the electrode portions C1 and C2, so that each of the heat generating resistors 301-1 and 301-2 connected in series generates heat. The heat generating resistors 301-1 and 301-2 are made to have the same length. The length region of these heat generating resistors 301-1 and 301-2 constitutes the maximum heat generation region width A. A center-basis feeding line (phantom line) O for the sheet P is located at a position substantially corresponding to a bisection position of the maximum heat generation region width A of the heater 300.

The heater 300 is fitted into the heater fitting groove 201*a* of the heater supporting member 201 so that the front surface thereof is directed upward and so that the high heat-conductive member 220 is interposed between the heater back surface and the heater supporting member 201 in the groove 201*a*, and thus is supported by the heater supporting member 201. The high heat-conductive member 220 is a member for suppressing a non-sheet-passing portion temperature rise during continuous sheet passing of the small-sized paper, and is interposed between the heater back surface and the heater supporting member 201 by being sandwiched between the heater back surface and a bearing surface of the groove 201*a*.

In FIG. 4, (a) shows a state in which the high heat-conductive member 220 having a size and a shape such that the high heat-conductive member 220 covers a range longer than at least the heat generation region of the heat generating resistors 301-1 and 301-2 is disposed superposedly on the heater substrate back surface. The high heat-conductive member 220 is disposed at the heater substrate back surface so as to cover at least a region corresponding to the maximum heat generation region width A of the heater 300.

The high heat-conductive member 220 is sandwiched and interposed between the heater back surface and the bearing surface of the groove 201*a* in a state in which the heater 300 is fitted into the heater fitting groove 201*a* of the heater supporting member 201 with the upward front surface and is thus supported by the heater supporting member 201. Further, the high heat-conductive member 220 is sandwiched and pressed between the heater supporting member 201 and the heater 300 by the pressing force of the above-described pressing mechanisms 252 (L, R).

FIG. 5 is an enlarged view of FIG. 2 in a region where the film 202 and the pressing roller 208 contact each other. The sheet P and the pressing roller 208 are omitted from illustration. The inner surface of the film 202 and the (front) surface of the surface protecting layer 304 of the heater 300 contact each other to form the nip N between the film 202 and the pressing roller 208.

The high heat-conductive member 220 is a member higher in thermal conductivity than the heater 300. In this embodiment, as the high heat-conductive member 220, an anisotropic heat-conductive member (high heat-conductive sheet) higher in thermal conductivity with respect to a planar (surface) direction than the heater substrate 303 is used.

Compared with the heater substrate 303, as a material having a high thermal conductivity with respect to the planar direction, it is possible to use a flexible sheet-shaped member or the like using, e.g., graphite. The high heat-conductive member 220 in this embodiment is the flexible sheet-shaped member using graphite as the material therefor, and the thermal conductivity with respect to a sheet surface direction thereof is higher than the thermal conductivity of the heater 300. In this embodiment, as the high heat-conductive member 220, the graphite sheet of 1000 V/mK in thermal conductivity with respect to the planar direction, 15 W/mK in thermal conductivity with respect to a thickness direction, 70 μm in thickness and 1.2 g/cm$^3$ in density was used. The thickness of the graphite sheet suitable for use in this embodiment is 60 μm to 1 mm.

A thermistor (temperature detecting element) 211 and a protecting element 212, such as a thermoswitch, a temperature fuse or a thermostat, in which a switch is provided are contacted to the high heat-conductive member 220, and are configured to receive the heat from the heater 300, via the high heat-conductive member 220, fitted into and supported by the heater fitting groove 201*a* of the heater supporting member 201. The thermistor 211 and the protecting element 212 are pressed against the high heat-conductive member 212 by an urging member (not shown) such as a leaf spring.

The thermistor 211 and the protecting element 212 are positioned and disposed in one end side and the other end side, respectively, with respect to the center basis feeding line O as a boundary as shown in (b) of FIG. 4. Further, both the thermistor 211 and the protecting element 212 are disposed in the passing region of a minimum-sized sheet P capable of passing through the fixing device 200. The thermistor 211 is the temperature detecting element for temperature-controlling the heater 300 as described above. The protecting element 212 is connected in series to an energization circuit to the heater 300 as shown in FIG. 6, and operates when the heater 300 is abnormally increased in temperature to interrupt an energization line to the heat generating resistors 301-1 and 301-2.

(4) Electric Power Controller for Heater 300

Figure 7:
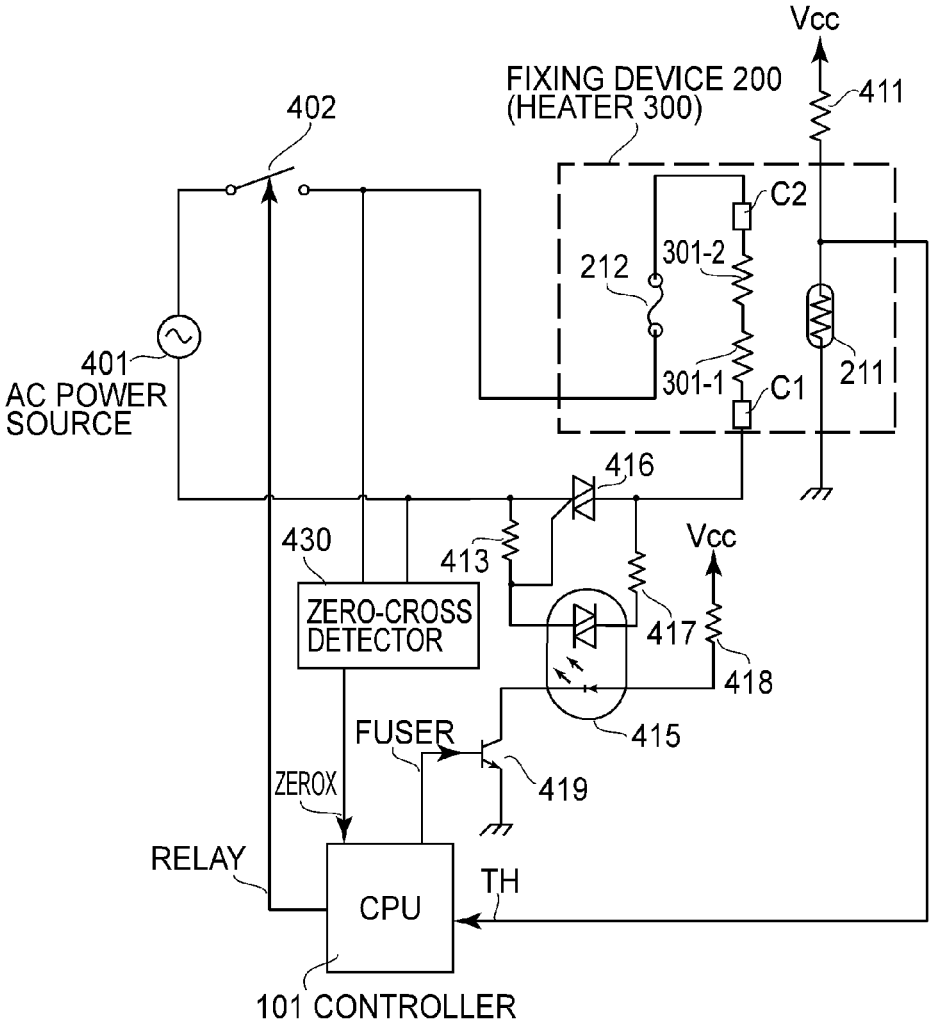
FIG. 7 is a control circuit diagram of the heater.

FIG. 7 shows an electric power controller for the heater 300 in this embodiment, in which a commercial AC power source 401 is connected to the printer 100. The electric power control of the heater 300 is effected by energization and interruption of a triac 416. The electric power supply to the heater 300 is effected via the electrode portions C1 and C2, so that the electric power is supplied to the heat generating resistors 301-1 and 301-2 of the heater 300.

A zero-cross detecting portion 430 is a circuit for detecting zero-cross of the AC power source 401, and outputs a zero-cross ("ZEROX") signal to the controller (CPU) 101. The ZEROX signal is used for controlling the heater 300, and as an example of a zero-cross circuit, a method described in JP-A 2011-18027 can be used.

An operation of the triac 416 will be described. Resistors 413 and 417 are resistors for driving the triac 416, and a photo-triac coupler 415 is a device for ensuring a creepage distance for insulation between a primary side and a secondary side. The triac 416 is turned on by supplying the electric power to a light-emitting diode of the photo-triac coupler 415. A resistor 418 is a resistor for limiting a current of the light-emitting diode of the photo-triac coupler 415. By controlling a transistor 419, the photo-triac coupler 415 is turned on and off.

The transistor 419 is operated by a "FUSER" signal from the controller 101. A temperature detected by the thermistor 211 is detected by the controller in such a manner that a divided voltage between the thermistor 211 and a resistor 411 is inputted as a "TH" signal into the controller 101. In an inside process of the controller 101, on the basis of a detection temperature of the thermistor 211 and a set temperature for the heater 300, the electric power to be supplied is calculated by, e.g., PI control. Further, the electric power is converted into control level of a phase angle (phase control) and wave number (wave number control) which correspond to the electric power to be supplied, and then the triac is controlled depending on an associated control condition.

For example, in the case where the fixing device 200 is in a thermal runaway state by a breakdown, of the electric power controller, such as short circuit of the triac 416, the protecting element 212 operates, and interrupts the electric power supply to the heater 300. Further, in the case where the controller 101 detects that the thermistor detection temperature ("TH" signal) is a predetermined temperature or more, the controller 101 places a relay 402 in a non-energization state, and thus interrupts the electric power supply to the heater 300.

(5) Pressing Method of Heater and High Heat-Conductive Sheet

Figure 8:
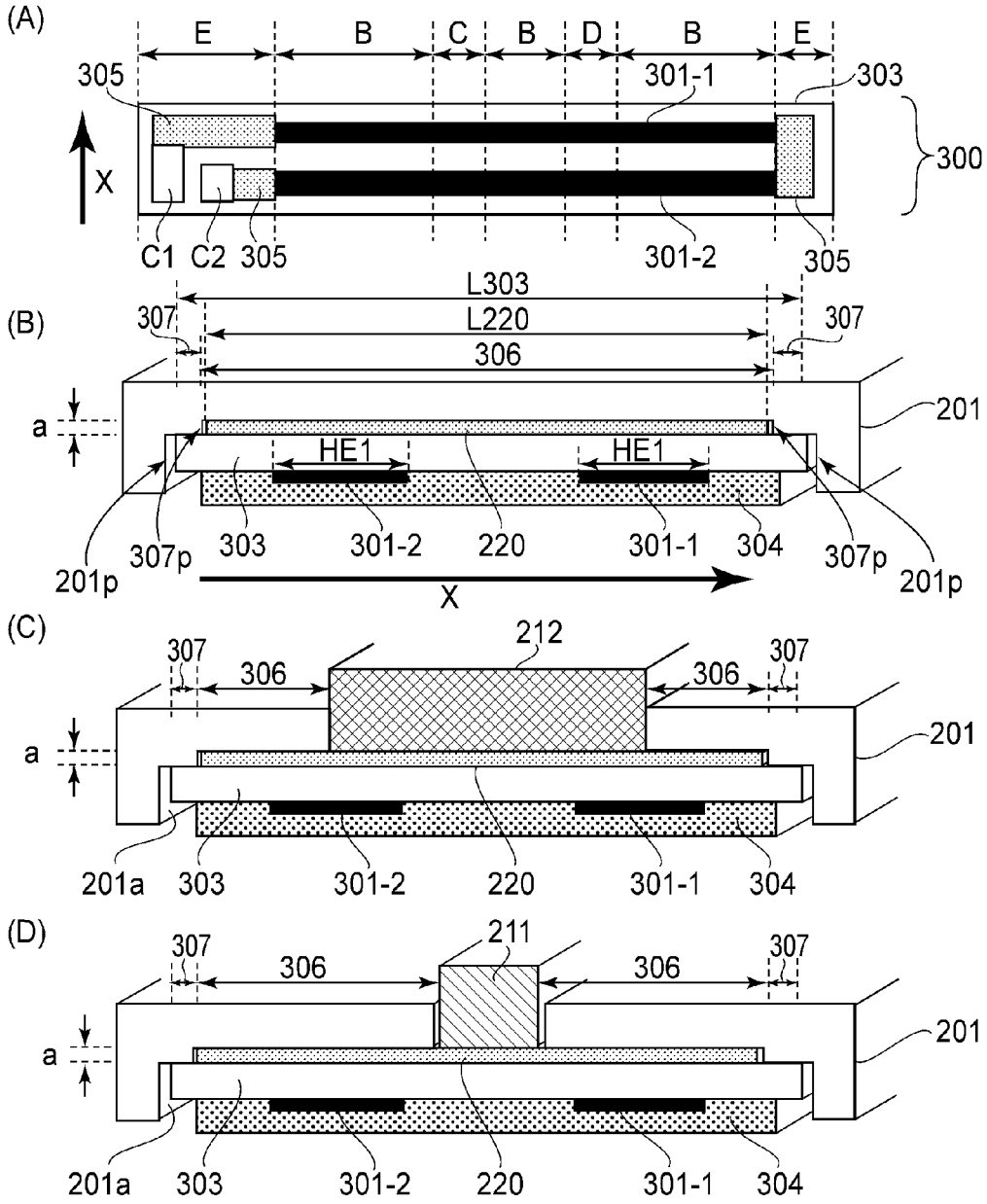
In FIG. 8, (A) to (D) are illustrations of a pressing method of the heater and a high heat-conductive sheet.

In FIG. 8, (A) to (D) are schematic views for illustrating a pressing method of the heater 300 and the high heat-conductive sheet 220 and a shape of the heater supporting member 201.

The high heat-conductive sheet 220 is provided between the heater supporting member 201 and the heater 300. The high heat-conductive sheet 220 is sandwiched between the heater supporting member 201 and the heater 300 in a pressed state by the pressing force of the above-described pressing mechanisms 252 (L, R).

The heater supporting member 201 includes a first bearing surface 306 for supporting the high heat-conductive sheet 220 and the heater 300 and a second bearing surface (opposing portion) 307 opposing the heater 300. Further, a height a of a stepped portion between the first bearing surface 306 and the second bearing surface 307 is constituted so as to be smaller than the thickness of the high heat-conductive sheet 300. That is, the supporting member 201 is provided with the bearing surface 306 contacting the sheet 220 so as to apply the pressure to between the heater 300 and the sheet 220 and the opposing portion 307 opposing a surface where the supporting member 201 contacts a sheet-contactable surface without via the sheet 220. Incidentally, as shown in FIG. 8, with respect to the recording material movement direction X (rotational direction R202 of the film 202), a width L220 of the sheet 220 is narrower than a width L303 of the heater 300.

This structure will be described specifically. In FIG. 8, (A) is the schematic view of the heater 300 in the (front) surface side, and (B) is a sectional view showing a cross-section of the heater 300 in a region B, as a central portion with respect to the longitudinal direction of the heater 300, of (A) of FIG. 8.

The heater supporting member 201 includes the stepped portion, having the height a, between the bearing surface 306 and the bearing surface 307, and the high heat-conductive sheet 220 is sandwiched between an inside of the stepped portion (height: a) of the heater supporting member 201 and is adjusted to a distance depending on a compression ratio of the high heat-conductive sheet 220 after the pressure application.

In FIG. 8, (C) is a sectional view of a cross-section of the heater 300 in a region C, of (A) of FIG. 8, where the protective element 212 is contacted to the high heat-conductive sheet 220.

In FIG. 8, (D) is a sectional view of a cross-section of the 300 in a region D, of (A) of FIG. 8, where the thermistor 211 is contacted to the high heat-conductive sheet 220.

As shown in (B) to (D) of FIG. 8, the heater supporting member 201 has the bearing surface 306, at a position perpendicular to each of heat generation regions of the heat generating resistors 301-1 and 301-2, where the high heat-conductive sheet 220 and the heater substrate 303 are contacted to each other by the heater supporting member 201. That is, in each of the cross-sections in (B) to (D) of FIG. 8, the heat generation region HE1 and the region of the bearing surface 306 overlaps with the bearing surface 306 with respect to the direction X.

Further, the heater supporting member 201 includes the stepped portion (height: a) between the bearing surface 306 and the bearing surface 307, and in an area of the stepped portion (height: a), the sheet 220 is disposed. As a result, the positional relationship of the high heat-conductive sheet 220 relative to the heater substrate 303 can be fixed. That is, as shown in (B) of FIG. 8, with respect to the direction X, the two bearing surfaces (opposing portions) 307 are provided, and thus two surfaces 307*p*, which are side surfaces of the two bearing surfaces 307, exist. During assembling of the fixing device, when the sheet 220 is inserted into between the two side surfaces 307*p*, the position of the sheet 220 with respect to the direction X is substantially determined. Further, when also the heater 300 is inserted into between two surfaces 201*p*, the position of the heater 300 with respect to the direction X is substantially determined. Accordingly, even in the fixing device using the sheet having the width L220 narrower than the width L303 of the heater, the positional relationship between the heater 300 and the sheet 220 can be substantially determined, so that the temperature non-uniformity eliminating function of the sheet 220 can be effectively used.

Further, the depth or height (distance) a of the stepped portion of the heater supporting member 201 is adjusted to a magnitude depending on a degree of compression of the sheet 220 after the sheet 220 is pressed springs 252L and 252R, so that the sheet 220 and the heater substrate 303 can be contacted to each other at a certain pressure. As a result, heat generation of the heat generating resistors 301-1 and 301-2 can be efficiently conducted to the sheet 220.

Figure 9:
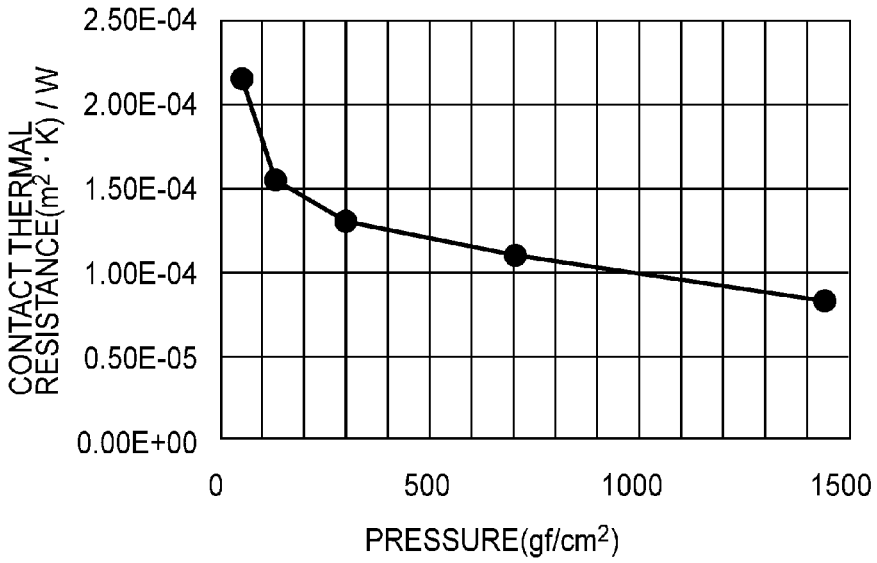
FIG. 9 is a graph showing a relationship between a pressure and a contact thermal resistance of the heater and the high heat-conductive sheet.

The relationship between the height a of the stepped portion of the heater supporting member 201 and the thickness of the sheet 220 described above will be described with reference to FIG. 9. FIG. 9 shows the relationship of the contact thermal resistance and the pressure between the sheet 220 and the heater substrate 303. FIG. 9 shows that the heat conduction from the heater to the sheet cannot be nearly obtained. That is, a predetermined pressure is needed for obtaining the heat conduction between the sheet 220 and the heater substrate 303.

Figure 10:
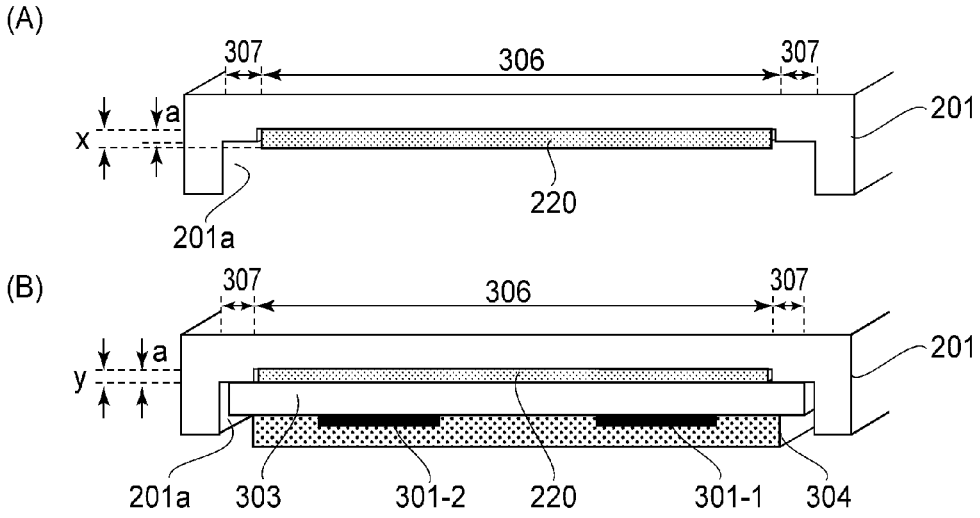
In FIG. 10, (A) and (B) are illustrations showing a compression ratio of the high heat-conductive sheet.

In FIG. 10, (A) and (B) show a relationship between the compression ratio of the sheet 220 and the stepped portion (height: a) between the bearing surfaces 306 and 307 of the heater supporting member 201. In FIG. 10, (A) shows the sheet 220 and the heater supporting member 201 when the sheet 220 is not pressed. The stepped portion between the bearing surfaces 306 and 307 of the heater supporting member 201 is a, and the thickness of the sheet 220 under no-pressure application is x. At this time, a relationship between the height a of the stepped portion, between the bearing surfaces 306 and 307 of the heater supporting member 201, and the thickness x of the sheet 220 in a non-pressure state is $a<x$.

In FIG. 10, (B) shows the sheet 220, the heater supporting member 201 and the heater 300 when the sheet 220 is pressed by the springs 252L and 252R. The thickness of the sheet 220 having the pressure application is y. At this time, the height a of the stepped portion between the bearing surfaces 306 and 307 of the heater supporting member 201 satisfies: $a \leq y$. That is, the height a of the stepped portion between the first bearing surface 306 and the second bearing surface 307 is equal to or small than the thickness y after the sheet 220 is pressed.

For example, when the pressure at the bearing surface 306 is 1000 (gf/cm$^2$), and a thickness compression ratio of the sheet 220 at this time is 8%, the thickness of the sheet 220 after the pressure application is $0.92 \times x$. Therefore, the height a of the stepped portion between the bearing surfaces 306 and 307 satisfies $a \leq 0.92 \times x$.

In this way, the sheet 220 is contacted to the heater substrate 303 in a compression state, i.e., the sheet thickness is not less than the height of the stepped portion between the bearing surface 306 and the opposing portion 307 in the state in which the pressure is applied to between the heater and the sheet, so that a dimensional tolerance of the heater 220 with respect to the thickness direction can be absorbed, and thus the sheet 220 and the heater substrate 303 can be contacted to each other at a predetermined pressure.

Figure 11:
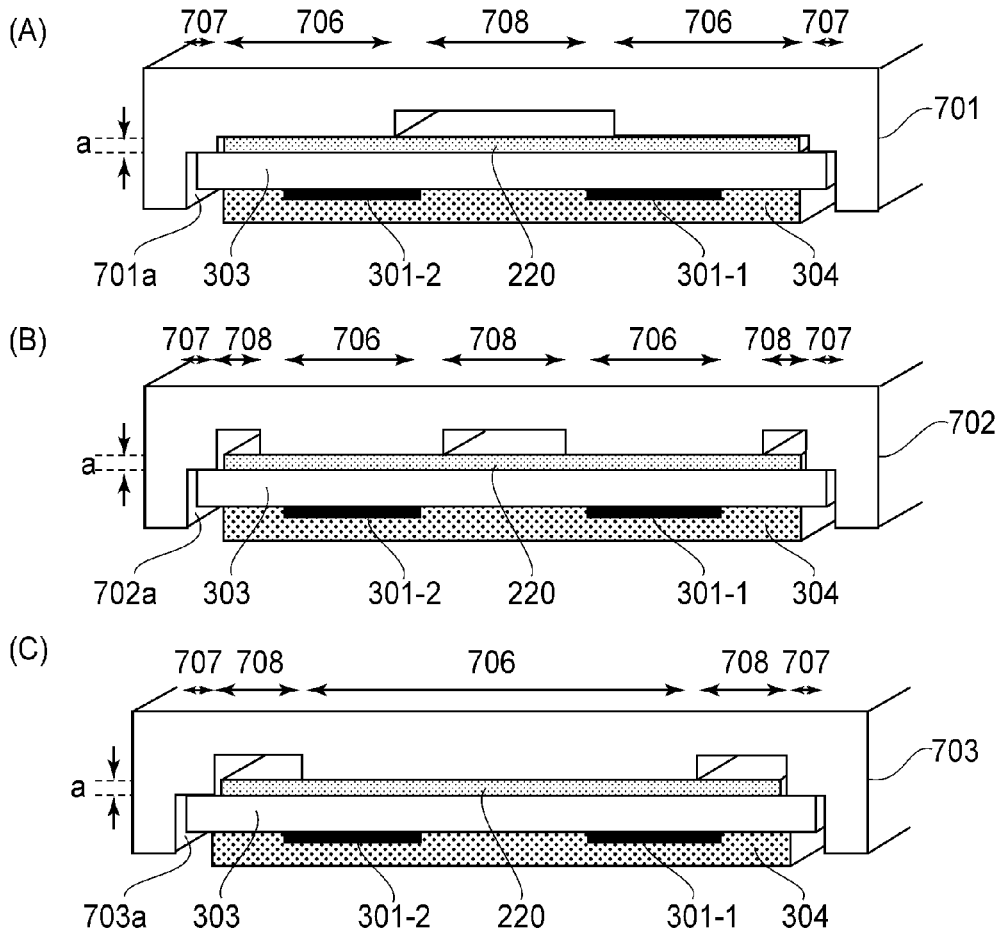
In FIG. 11, (A) to (C) are illustrations of a modified example of a heater supporting member.

In FIG. 11, (A) to (C) show modified embodiments. In FIG. 11, each of a heater supporting member 701 in (A), a heater supporting member 702 in (B) and a heater supporting member 703 in (C) includes a first bearing surface 706, a bearing surface 708 where the heater supporting member opposes the sheet and is recessed from the sheet relative to the bearing surface 706, and a second bearing surface (opposing portion) 707.

Also in these examples, a constitution in which the height a of the stepped portion between the first bearing surface 706 and the second bearing surface 707 is smaller than the thickness of the sheet 220 after the sheet 220 is pressed is employed.

This constitution will be specifically described. Each of the heater supporting member 701 of (A) of FIG. 11, the heater supporting member 702 of (B) of FIG. 11, and the heater supporting member 703 of (C) of FIG. 11 includes the bearing surface 708. For that reason, heat dissipation from the sheet 220 toward the heater supporting member can be suppressed.

Incidentally, the (planar) area of the bearing surface 706 of the heater supporting member 701 is smaller than the (planar) area of the bearing surface 306 of the heater supporting member 201 by the (planar) area of the bearing surface 708. Therefore, in the case where the heater supporting members 701 and 201 are pressed by the same force, the pressure by the bearing surface 706 is higher than the pressure by the bearing surface 306.

For example, the case where the area of the bearing surface 706 is ⅔ of the area of the bearing surface 306 and the pressure by the bearing surface 306 is 1000 (gf/cm$^2$) will be considered. In this case, the pressure by the bearing surface 706 is 1500 (gf/cm$^2$). At this time, when the compression ratio of the sheet 220 is about 11% and the thickness of the sheet 220 in the non-pressure application state, the thickness of the sheet 220 after the pressure application is about $0.89 \times x$. Therefore, the height a of the stepped portion between the bearing surfaces 706 and 707 satisfied: $a \leq 0.89 \times x$.

Embodiment 2

Embodiment 2 in which the heater supporting member for the heater 300 to be mounted in the fixing device 200 is changed will be described. Constituent elements similar to those in Embodiment 1 will be omitted from illustration. In this embodiment, each of the bearing surface and the opposing portion of the heater supporting member has curvature (crown shape) with respect to a longitudinal direction (of the supporting member) perpendicular to the film movement direction of the heater. Further, the height of stepped portion between the bearing surface and the opposing portion is substantially the same over the longitudinal direction of the supporting member.

Figure 12:
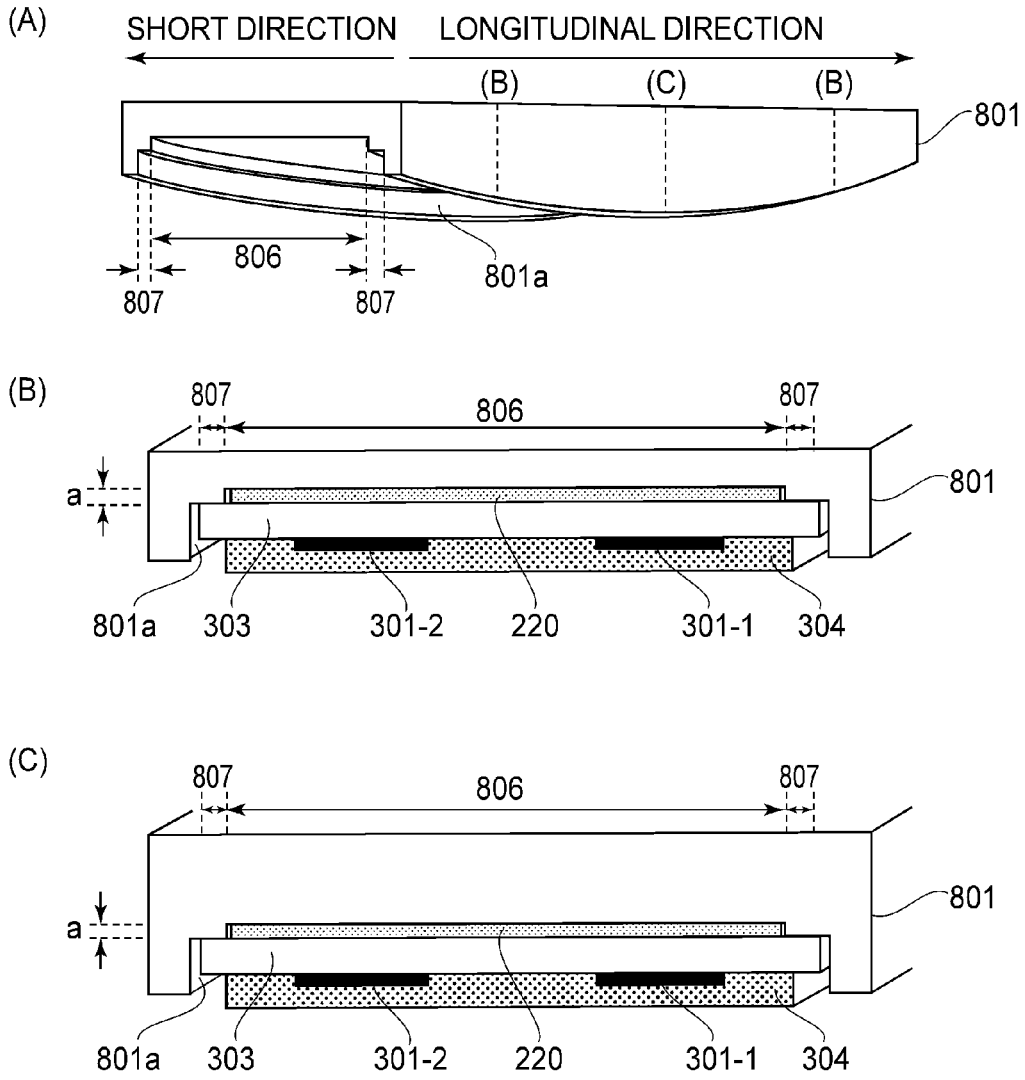
In FIG. 12, (A) to (C) are illustrations of a pressing method of a heater and a high heat-conductive member in Embodiment 2.

This constitution will be specifically described. In FIG. 12, (A) is a perspective view of a heater supporting member 801. A surface 806 is a sheet pressing surface where the heater supporting member 801 presses the sheet, and a surface 807 is an opposing portion (opposing surface) opposing a sheet-contactable surface of the sheet without via the sheet.

The heater supporting member 801 has the crown shape with respect to the longitudinal direction of the heater substrate (or the longitudinal direction of the supporting member), so that each of the bearing surfaces 806 and 807 is a surface having certain curvature with respect to the longitudinal direction.

The crown shape is a shape capable of generating uniform pressure in the nip with respect to the longitudinal direction.

In FIG. 12, (B) is a sectional view of a cross-section in the neighborhood of a longitudinal end portion (B) in (A) of FIG. 12. The heater supporting member 801 has the stepped portion (height: a) between the bearing surfaces 806 and 807, and the sheet 220 is sandwiched between an inside of the stepped portion and the heater 300. The depth of the stepped portion of the heater supporting member 801 is not more than the thickness of the sheet 220 after the pressure application as described above with reference to FIG. 10.

In FIG. 12, (C) is a sectional view of a cross-section in the neighborhood of a longitudinal central portion (C) in (A) of FIG. 12. The bearing surfaces 806 and 807 in (C) of FIG. 12 are lower than the bearing surfaces 806 and 807 in (B) of FIG. 12 correspondingly to the curvature of the heater supporting member 801.

Incidentally, the pressure of the bearing surface 806 in the area (C) is equal in value to the pressure of the bearing surface 806 in the area (B) since the pressure of the heater supporting member 801 having the crown shape is uniform with respect to the longitudinal direction of the heater supporting member 801. Therefore, the height a of the stepped portion of the heater supporting member 801 in the area (C) is equal in value to the height a of the stepped portion of the heater supporting member 801 in the area (B). That is, the height a of the stepped portion is substantially the same over the depth of the supporting member.

As shown in this embodiment, the constitution of the present invention is applicable to also the heater supporting member 801 having the crown shape.

Embodiment 3

Embodiment 3 in which the heater supporting member to be mounted in the fixing device 200 is changed will be described. Constituent elements similar to those in Embodiment 1 will be omitted from illustration.

Figure 13:
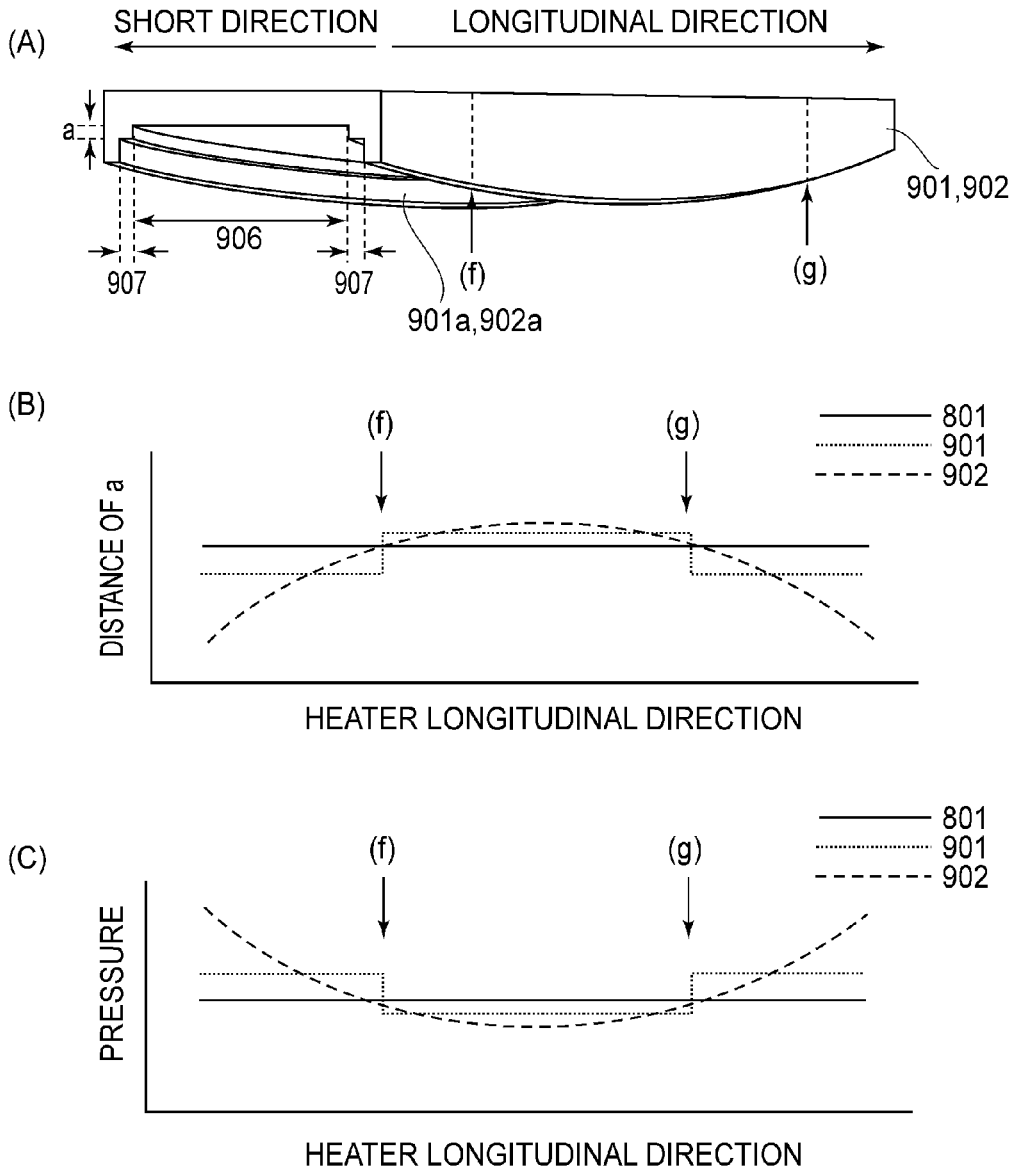
In FIG. 13, (A) to (C) are illustrations of a pressing method of a heater and a high heat-conductive member in Embodiment 3.

In FIG. 13, (A) is a perspective view of a heater supporting member 901 or 902 in this embodiment. The supporting members 901 and 902 are merely different in crown shape from each other and therefore the perspective view of (A) of FIG. 13 is common to the supporting members 901 and 902. Each of the heater supporting members 901 and 902 has the crown shape with respect to the longitudinal direction.

In this embodiment, a height of the stepped portion between bearing surfaces 906 and 907 of each of the heater supporting members 901 and 902 is a. The heater supporting members 901 and 902 are different in longitudinal distribution of the height (distance) a of the stepped portion.

In FIG. 13, (B) shows the relationship between the stepped portion distance (height) a and the longitudinal position of the heater 300.

In (B) of FIG. 13, a rectilinear line indicated by a solid line 801 shows a distribution of the depth a of the heater supporting member 801 in Embodiment 2.

In (B) of FIG. 13, a rectangular line indicated by a dotted line 901 shows a distribution of the depth a of the heater supporting member 901 in this embodiment. The depth a from each of points (f) and (g) toward an associated end portion side is smaller than the depth a in an area between the points (f) and (g) by a certain length. Further, a curved line indicated by a broken line 902 shows a distribution of the depth a of the heater supporting member 902 in this embodiment, and the depth a is gradually decreased from a longitudinal center of the heater supporting member 902.

In FIG. 13, (C) is a graph showing a relationship between the pressure applied to the bearing surface 906 and the longitudinal position of the heater. A rectilinear line indicated by a solid line 801 shows the pressure of the bearing surface 806 of the heater supporting member 801, and the pressure is constant with respect to the heater longitudinal direction.

On the other hand, a rectangular line indicated by a dotted line 901 in (C) of FIG. 13 shows the pressure of the bearing surface 906 of the heater supporting member 901, and the pressure in areas from each of the longitudinal points (f) and (g) toward the associated end portion side is higher than the pressure in the area between the longitudinal points (f) and (g). This is because the pressure concentrates at a portion (end portion) where the depth a is small.

In (C) of FIG. 13, a curved line indicated by a broken line 902 shows the pressure of the bearing surface 906 of the heater supporting member 902, and the pressure gradually increases from the longitudinal center toward the end portion sides. This is because the depth a decreases with a position toward the end portion, and therefore the pressure gradually increases with the position closer to the end portion.

In this way, with respect to each of the supporting members 901 and 902, the pressure applied to the bearing surface 906 in the neighborhood of the longitudinal end portion of the heater is higher than the pressure applied to the bearing surface 906 at the longitudinal central portion of the heater.

As a result, from the relationship of the contact thermal resistance between the heater 300 and the sheet 220, the contact thermal resistance between the heater 300 and the sheet 220 is lower in the neighborhood of the longitudinal end portions of the heater than at the longitudinal central portion of the heater. For that reason, the heat at the longitudinal end portions of the heater can be efficiently conducted to the sheet 220, so that a temperature distribution non-uniformity of the heater can be alleviated.

Incidentally, the shape the heater supporting (holding) members 901 and 902 is merely an example of a shape for increasing the pressure in the neighborhood of the longitudinal end portions of the heater, but is not limited to the shape described in this embodiment.

The image heating apparatus in the present invention includes, in addition to the apparatus for heating the unfixed toner image (visualizing agent image, developer image) to fix or temporarily fix the image as a fixed image, an apparatus for heating the fixed toner image again to improve a surface property such as glossiness.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 237911/2013 filed Nov. 18, 2013, which is hereby incorporated by reference.

What is claimed is:

1. An image heating apparatus comprising:

a heater;

a supporting member configured to support said heater; and a high heat conductive sheet sandwiched between said heater and said supporting member, wherein a recording material on which an image is formed is heated by heat from said heater, wherein said supporting member includes a bearing surface contacting said sheet and an opposing surface opposing a part of said heater not opposing said sheet, the bearing surface and the opposing surface forming a stepped portion in which the opposing surface is positioned closer to said heater than the bearing surface in a thickness direction of said heater, wherein the thickness of said sheet under a non-pressure state is larger than the height of the stepped portion between the bearing surface and the opposing surface, and wherein in a state in which pressure is applied between said heater and said supporting member, said sheet is compressed between said heater and the bearing surface of said supporting member such that said heater contacts the opposing surface of said supporting member.

2. An image heating apparatus according to claim 1, wherein with respect to a movement direction of the recording material, the width of said sheet is narrower than the width of said heater.

3. An image heating apparatus according to claim 1, wherein each of the bearing surface and the opposing surface has a crown shape such that the thickness of said supporting member at a portion where the bearing surface is provided and the thickness of said supporting member at a portion where the opposing surface is provided are thicker at an end portion than at a central portion with respect to a longitudinal direction of said supporting member.

4. An image heating apparatus according to claim 1, wherein the sheet is composed of graphite.

5. An image heating apparatus according to claim 4, wherein said sheet has a thickness of 60 μm to 1 mm.

6. An image heating apparatus according to claim 1, further comprising a cylindrical film rotatable while contacting said heater at an inner surface thereof.

7. An image heating apparatus comprising:

a cylindrical film;

a nip forming member contacting an inner surface of said film;

a supporting member configured to support said nip forming member; and a high heat conductive sheet sandwiched between said nip forming member and said supporting member, wherein a recording material on which an image is formed is heated by heat from said film, wherein said supporting member includes a bearing surface contacting said sheet and an opposing surface opposing a part of said nip forming member not opposing said sheet, the bearing surface and the opposing surface forming a stepped portion in which the opposing surface is positioned closer to said nip forming member than the bearing surface in a thickness direction of said nip forming member, wherein the thickness of said sheet under a non-pressure state is larger than the height of the stepped portion between the bearing surface and the opposing surface, and wherein in a state in which pressure is applied between said nip forming member and said supporting member, said sheet is compressed between said nip forming member and the bearing surface of said supporting member such that said nip forming member contacts the opposing surface of said supporting member.

8. An image heating apparatus according to claim 7, wherein with respect to a movement direction of the recording material, the width of said sheet is narrower than the width of said nip forming member.

9. An image heating apparatus according to claim 7, wherein each of the bearing surface and the opposing surface has a crown shape such that the thickness of said supporting member at a portion where the bearing surface is provided and the thickness of said supporting member at a portion where the opposing surface is provided are thicker at an end portion than at a central portion with respect to a longitudinal direction of said supporting member.

10. An image heating apparatus according to claim 7, wherein sheet is composed of graphite.

11. An image heating apparatus according to claim 10, wherein said sheet has a thickness of 60 μm to 1 mm.

* * * * *